US011205331B2

(12) United States Patent
Pilli et al.

(10) Patent No.: US 11,205,331 B2
(45) Date of Patent: Dec. 21, 2021

(54) DEVICE AND A METHOD FOR PROVIDING AN INDICATION TO A USER REGARDING EVENTS

(71) Applicant: Carrier Corporation, Palm Beach Gardens, FL (US)

(72) Inventors: Srinivasa Reddy Pilli, Telangana (IN); Prasad Babu Lakshmipathy, Telangana (IN); Raghuveer Pallerla, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/112,047

(22) Filed: Dec. 4, 2020

(65) Prior Publication Data

US 2021/0327236 A1 Oct. 21, 2021

(30) Foreign Application Priority Data

Apr. 15, 2020 (IN) ..... 202011016296

(51) Int. Cl.

| | |
|---|---|
| ***G08B 17/00*** | (2006.01) |
| ***G08B 17/06*** | (2006.01) |
| ***G08B 17/10*** | (2006.01) |
| ***G08B 29/04*** | (2006.01) |
| ***G08B 21/18*** | (2006.01) |
| ***G08B 5/36*** | (2006.01) |

(52) U.S. Cl.

CPC ..... *G08B 17/06* (2013.01); *G08B 5/36* (2013.01); *G08B 17/10* (2013.01); *G08B 21/182* (2013.01); *G08B 29/043* (2013.01)

(58) Field of Classification Search

CPC ..... G08B 17/06; G08B 5/36; G08B 29/043; G08B 17/10; G08B 21/182

See application file for complete search history.

(56) References Cited

U.S. PATENT DOCUMENTS 4,527,189 A * 7/1985 Ooi ..... H04N 9/735 348/223.1
6,456,418 B1 * 9/2002 Martin ..... C07D 241/46 252/583

(Continued)

OTHER PUBLICATIONS

Alesanco et la., "All-in-One Gel-Based Electrochromic Devices: Strengths and Recent Developments", Materials 2018, 11, 414; doi:10.3390/ma11030414; 27 pages.

(Continued)

*Primary Examiner* — Ojiako K Nwugo
(74) *Attorney, Agent, or Firm* — Cantor Colburn LLP

(57) ABSTRACT

A device and a method for providing an indication to a user regarding events associated with a device. A method includes detecting a plurality of events associated with a device and communicating the detected events to a controller of the device. The method includes generating a command for each of the detected events and communicating the command to a voltage generator of the device. The method includes generating voltage based on the command and applying the generated voltage to one or more electro-chromic layers of a plurality of electro-chromic layers embedded in the device. The method includes glowing a color by the one or more electro-chromic layers on the device by application of the generated voltage.

19 Claims, 8 Drawing Sheets

(56) References Cited

U.S. PATENT DOCUMENTS

| | | | | |
|---|---|---|---|---|
| 2005/0052349 | A1* | 3/2005 | Kuczynski | G09G 3/00 345/49 |
| 2011/0239790 | A1* | 10/2011 | Kuczynski | G01L 1/16 73/862.624 |
| 2012/0092182 | A1* | 4/2012 | Daniel | G08B 5/36 340/691.1 |
| 2012/0154892 | A1* | 6/2012 | Yashiro | G02F 1/1525 359/270 |
| 2016/0026059 | A1* | 1/2016 | Chung | B60R 1/088 359/275 |
| 2017/0238392 | A1* | 8/2017 | Shearer | H05B 47/11 315/153 |
| 2017/0269144 | A1* | 9/2017 | Connor | G01R 29/0878 |
| 2019/0221108 | A1* | 7/2019 | Harris | G08B 29/043 |
| 2019/0317458 | A1* | 10/2019 | Shrivastava | E06B 9/24 |
| 2019/0377915 | A1* | 12/2019 | Atkinson | G06K 7/10722 |
| 2020/0042934 | A1* | 2/2020 | Atkinson | G06Q 10/0833 |
| 2020/0160508 | A1* | 5/2020 | Atkinson | G06K 7/0004 |

OTHER PUBLICATIONS

Coleman et al., "Printed, flexible electrochromic displays using Interdigitated electrodes", Solar Energy Materials & Solar Cells 56 (1999) p. 395-418.

Jarosz et al., "Transparent to Black Electrochromism—The Holy Grail" of Organic Optoelectronics, MDPI, Polymers 2019, 11, 273, 18 pages.

Naijoh et al., "Multi-Layered Electrochromic Display", EP1-1, Invited; ISSN-L 1883-2490/18/0375 © 2011 ITE and SID, 4 pages.

* cited by examiner

DEVICE AND A METHOD FOR PROVIDING AN INDICATION TO A USER REGARDING EVENTS

FOREIGN PRIORITY

This application claims priority to Indian Patent Application No. 202011016296, filed Apr. 15, 2020, and all the benefits accruing therefrom under 35 U.S.C. § 119, the contents of which in its entirety are herein incorporated by reference.

TECHNICAL FIELD OF INVENTION

The present invention generally relates to fire detectors. More particularly, the invention relates to a device and a method for providing an indication to a user regarding events associated with a fire detector.

BACKGROUND OF THE INVENTION

Fire detectors are deployed in buildings to detect fire breakouts and notify residents of such a breakout. Existing fire detectors use multiple light emitting diodes (LEDs) which are present around a body of fire detectors to indicate various events. The color with which the LEDs blink or glow provides an indication of the nature of an event, which could be a normal working event or a trouble/alarm event or some such other event. Each of events requires a dedicated or separate LED on the fire detector to provide indication of that particular event. Furthermore, such existing fire detectors need a large number of LEDs in order to indicate different types of events associated with each fire detector. Moreover, it is difficult for a user to properly see and/or recognize glowing or blinking LEDs from a distance as the LEDs on the fire detectors are very small in size. In addition, some fire alarms coupled with the fire detectors produce alarms or sounds when the fire detectors detect any issue. However, the user may miss these alarms and it may be difficult for the user to understand the issue in the fire detector on hearing the alarms.

In view of the afore-mentioned problems in the existing solutions, there is a need of an effective solution for indicating a user regarding any type of event associated with a fire detector. There is also a requirement of a solution for indicating a user regarding any type of event associated with the fire detector without using light emitting diodes (LEDs). In order to solve the problems in the existing solutions, a device and a method are disclosed.

SUMMARY OF THE INVENTION

Various embodiments of the invention describe a device for providing an indication to a user regarding events associated with a device. The device comprises an event detection circuit adapted to detect a plurality of events associated with the device and communicate the detected events to a controller. Also, the device further comprises the controller adapted to generate a command for each of the detected events and communicate the command to a voltage generator of the device. The device also comprises the voltage generator adapted to generate voltage based on the command and apply the generated voltage to one or more electro-chromic layers of a plurality of electro-chromic layers embedded in the device. The one or more electro-chromic layers are adapted to glow with a color on the device by application of the generated voltage.

In an embodiment of the invention, the device is a fire detector.

In a different embodiment of the invention, the plurality of events detected by the event detection circuit comprises a normal working event, a low battery event, a warning event, an alarm event and/or a device expiration event.

In another embodiment of the invention, the warning event corresponds to an event when the device requires a maintenance, repair or a service or when the device is unable to communicate with a fire panel. Also, the alarm event corresponds to an event when the device detects any fire or smoke.

In yet another embodiment of the invention, the one or more electro-chromic layers' glow with a color on the device for providing an indication to a user regarding the detected events.

In another embodiment of the invention, the controller is coupled with a pulse width modulator (PWM) to control the voltage or current and an output of the pulse width modulator is used by the voltage generator to generate voltage. In yet another embodiment of the invention, the voltage generator applies the generated voltage to the one or more electro-chromic layers using a battery of the device.

In still another embodiment of the invention, each of the plurality of events is assigned with a low priority, a medium priority or a high priority.

In an embodiment of the invention, the plurality of electro-chromic layers is separated by an insulating layer and are placed at a bottom or side surface or at a body of the device.

In another embodiment of the invention, the one or more electro-chromic layers glow different colors at different generated voltage using red, green, yellow (RGY) spectrum or cyan, yellow, magenta (CYM) spectrum.

In yet another embodiment of the invention, the one or more electro-chromic layers glow in red color when an alarm event is detected, glow in shaded red color when a device expiration event is detected, glow in yellow color when a warning event is detected, glow in shaded yellow color if a maintenance/service event is detected, glow in green color when a normal working event is detected or glow in shaded green color when a low battery event is detected.

In a different embodiment of the invention, the one or more electro-chromic layers' glow in different colors by energizing or de-energizing the electro-chromic layers with application of different voltage.

Various embodiments of the invention describe a method for providing an indication to a user regarding events associated with a device. The method comprises steps of detecting a plurality of events associated with a device and communicating the detected events to a controller of the device. The method also comprises steps of generating a command for each of the detected events and communicating the command to a voltage generator of the device. The method further comprises steps of generating voltage based on the command and applying the generated voltage to one or more electro-chromic layers of a plurality of electro-chromic layers embedded in the device. The method comprises steps of glowing a color by the one or more electro-chromic layers on the device by application of the generated voltage.

In an embodiment of the invention, the device is a fire detector.

In a different embodiment of the invention, the plurality of events detected by the event detection circuit comprises a normal working event, a low battery event, a warning event, an alarm event and/or a device expiration event.

In an embodiment of the invention, each of the plurality of events is assigned with a low priority, a medium priority or a high priority.

In another embodiment of the invention, the controller employs a pulse width modulator (PWM) to control the voltage or current and an output of the pulse width modulator is used by the voltage generator to generate voltage.

In yet another embodiment of the invention, the one or more electro-chromic layers glow different colors at different generated voltage using red, green, yellow (RGY) spectrum or cyan, yellow, magenta (CYM) spectrum.

In another different embodiment of the invention, a computer readable medium is disclosed for providing an indication to a user regarding events associated with a device. The computer readable medium comprises one or more processors and a memory is coupled to the one or more processors, the memory stores instructions executed by the one or more processors. The one or more processors are configured to detect a plurality of events associated with a device and communicate the detected events to a controller of the device. The one or more processors are also configured to generate a command for each of the detected events and communicate the command to a voltage generator of the device. The one or more processors are further configured to generate voltage based on the command and apply the generated voltage to one or more electro-chromic layers of a plurality of electro-chromic layers embedded in the device. The one or more processors are further configured to glow a color by the one or more electro-chromic layers on the device by application of the generated voltage.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Described herein is a technology with a device and a method for providing an indication to a user regarding events associated with a device. The device may be installed in a premises and may detect a plurality of events associated with the device. The detected events may be communicated to a controller. The plurality of events may comprise, but is not limited to, a normal working event, a low battery event, a warning event, an alarm event and/or a device expiration event. Further, a command may be generated for each of the detected events and the command may be communicated to a voltage generator. The voltage generator may generate appropriate voltage based on the command and also apply the generated voltage to one or more electro-chromic layers embedded in the device. The one or more electro-chromic layers glow a color by application of the generated voltage to the one or more electro-chromic layers. The glowing of the one or more electro-chromic layers in a color provides an indication to a user regarding the detected events along with the priority or severity of the event. Accordingly, the user can take an appropriate action to resolve the detected events associated with the device.

As used herein, the device may comprise the plurality of electro-chromic layers placed at a bottom surface or side surface of the device. In an alternative embodiment, the plurality of electro-chromic layers may be placed anywhere within a body of the device. The device may also be installed in a premises and may sense fire or smoke in the premises. The premises may be a building, home, room and the like. In an exemplary embodiment, the device may be a fire detector, smoke detector, temperature sensor/thermal detector, or any other device which is associated with plurality of events.

As used herein, the controller may be communicably coupled with an event detection circuit and/or the voltage generator. In an exemplary embodiment, the controller may be a micro-controller, a processor and the like. As used herein, the voltage generator may be any voltage generator that is known in the art.

Figure 1A:
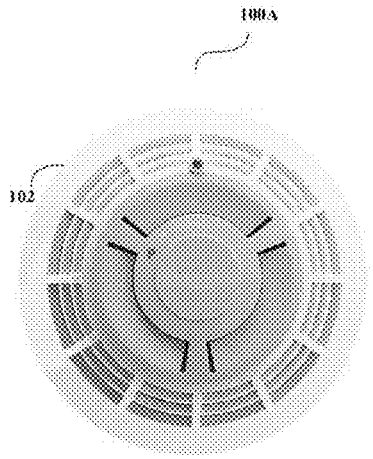
FIG. 1A depicts a top view of an exemplary device according to an exemplary embodiment of the invention.

FIG. 1A depicts a top view 100A of an exemplary device 102 according to an exemplary embodiment of the invention. As can be seen, the device 102 may be of a circular shape or can be of any other shape. The device 102 may be installed in a premises and may sense fire or smoke in the premises. The functionalities and/or operations of the device 102 are discussed in FIGS. 3 and 4 below.

Figure 1B:
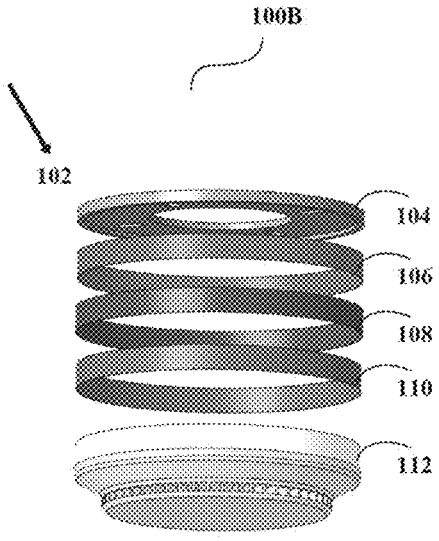
FIG. 1B depicts an exploded view of an exemplary device.

FIG. 1B depicts an exploded view 100B of an exemplary device 102 according to an exemplary embodiment of the invention. As depicted, the device 102 may comprise a mounting 104, a housing 112, and/or a plurality of electro-chromic layers i.e. a green electro-chromic layer 106, a yellow electro-chromic layer 108, and a red electro-chromic layer 110. Although, the FIG. 1B first depicts the placement of the green electro-chromic layer 106, followed by the yellow electro-chromic layer 108, and then the red electro-chromic layer 110; however, these different electro-chromic layers 106/108/110 can be the placed in any manner. Further, the mounting 104 may be used for placing or positioning the device 102. In an exemplary embodiment, the device 102 may be placed at a wall or a roof of the premises. The plurality of electro-chromic layers may be placed at a body of the device 102. In this exemplary embodiment, the plurality of electro-chromic layers may be placed at an inner surface/sides of the housing 112 of the device 102. Also, the device 102 may be designed to have at least 3 to 4 layers of electrochromic layers embedded/integrated to the housing 112 (may be made up of plastic). The thickness of each electro-chromic layers may be around 0.25 to 0.5 mm maximum. Each of the electro-chromic layers may have two shades of desired color which are described below in details.

Figure 1C:
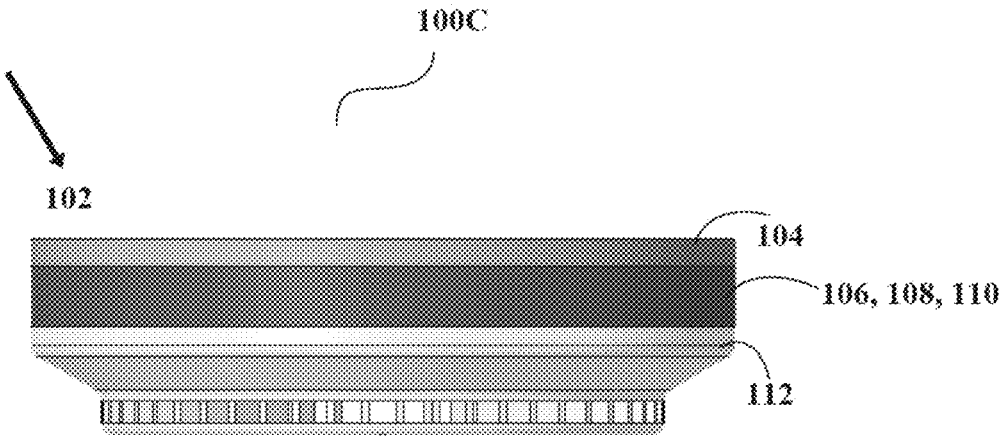
FIG. 1C depicts a front view of an exemplary device.

FIG. 1C depicts a front view 100C of an exemplary device 102 according to an exemplary embodiment of the invention. In the front view 100C, the plurality of electro-chromic layers 106/108/110 may be placed below the mounting 104 and placed at the housing 112 of the device 102.

Figure 1D:
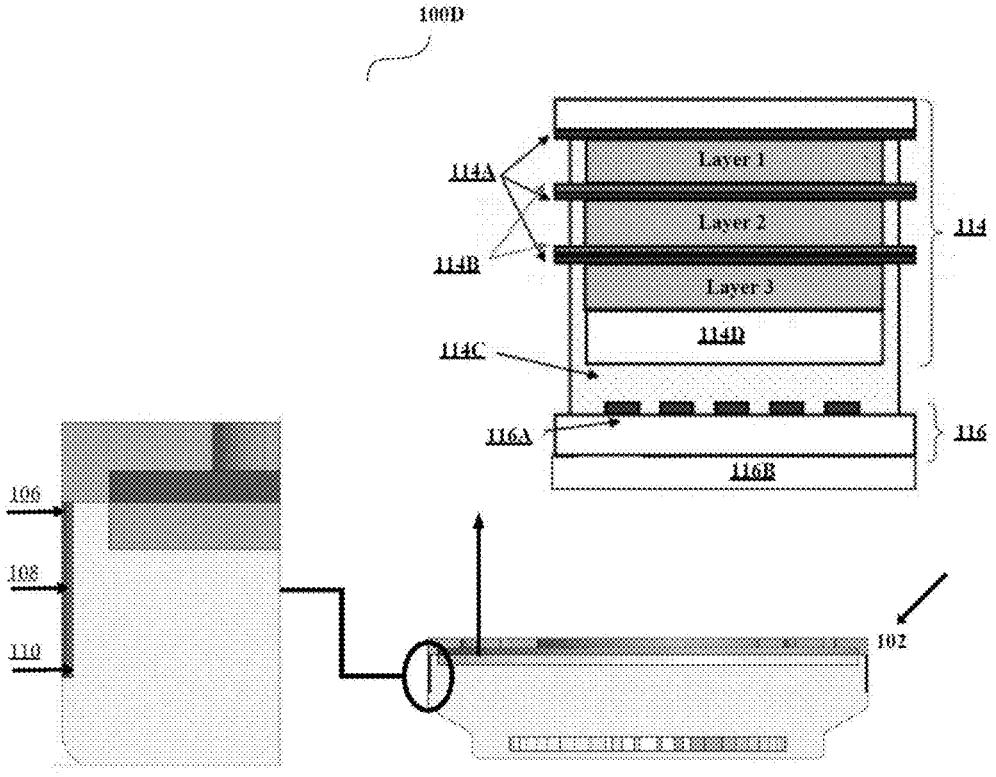
FIG. 1D depicts an exemplary arrangement of a plurality of electro-chromic layers of an exemplary device according to an exemplary embodiment of the invention.

FIG. 1D depicts an exemplary arrangement 100D of a plurality of electro-chromic layers of an exemplary device 102 according to an exemplary embodiment of the invention. In encircled portion, the plurality of electro-chromic layers 106/108/110 may be sandwiched and integrated in the housing 112 of the device 102. As can be seen, the plurality of electro-chromic layers 106/108/110 may be placed at the inner surface/sides of the housing 112 of the device 102. Further, as shown in the left side of the FIG. 1D, the green electro-chromic layer 106 may be placed at the outer-most side of the housing 112. The yellow electro-chromic layer 108 may be placed between the green electro-chromic layer 106 and the red electro-chromic layer 110. Then, the red electro-chromic layer 110 may be placed at inner-most side of the housing 112.

Moreover, the top-right side of the FIG. 1D shows a front plane 114 of the device 102. The front plane 114 of the device 102 may comprise, but is not limited to, one or more transparent electrodes 114A, one or more insulating layers 114B, electrolyte 114C and/or a white reflective layer 114D. The front plane 114 may further, comprise a magenta electro-chromic layer (Layer 1), a yellow electro-chromic layer (Layer 2), and/or a cyan electro-chromic layer (Layer 3) i.e. CMY. Alternatively, the front plane 114 may comprise green electro-chromic layer 106, yellow electro-chromic layer 108, and/or red electro-chromic layer 110 as described above. Further, a single transparent electrode 114A and a single insulating layers 114B may be placed between any two electro-chromic layers as shown in the front plane 114. The transparent 3D electrode/s 114A may comprise criss-crossed indium tin oxide (ITO) nanofibers that may be fabricated by a rapid and facile electrospinning. In this transparent 3D electrode, the nano-porous fiber-network of the ITO may be served as various criss-crossed electron channels to transmit both electrons and ions. The transparent 3D electrode/s 114A may also be capable of increasing the response rate when polarity is given. The response time of each transparent electrode 114A may be less than 1/30 in milliseconds scale. Moreover, the insulating layer/s 114B may be a thin layer acting as an insulator with very little or limiting electronic conductivity. Furthermore, the white reflective layer 114D may increase the contrast ratio and reflectivity compared to counter the counter electrode. Also, the top-right side of the FIG. 1D shows a backplane 116 of the device 102. The backplane 116 of the device 102 may comprise, but is not limited to, counter electrodes 116A and a non-transparent plastic layer 116B.

Figure 2A:
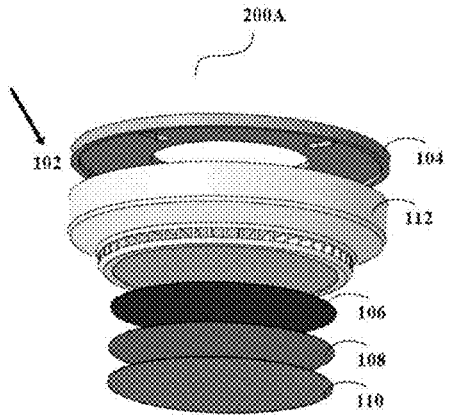
FIG. 2A depicts an exploded view of an exemplary device.
Figure 2B:
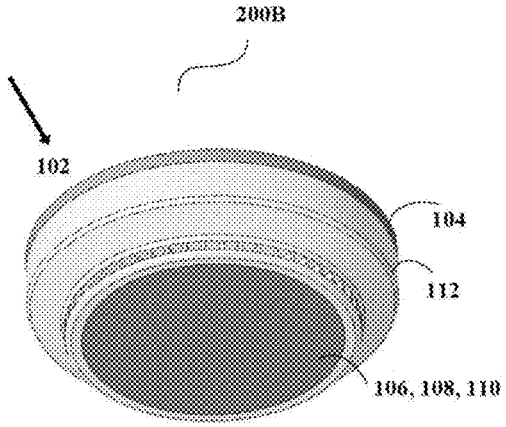
FIG. 2B depicts a front view of an exemplary device and FIG. 2C depicts an exemplary arrangement of a plurality of electro-chromic layers of an exemplary device according to a different exemplary embodiment of the invention.

FIG. 2A depicts an exploded view 200A of an exemplary device 102 according to a different exemplary embodiment of the invention. As depicted in the exploded view 200A, the device 102 may comprise a mounting 104, a housing 112, and/or a plurality of electro-chromic layers i.e. a green electro-chromic layer 106, a yellow electro-chromic layer 108, and a red electro-chromic layer 110. As explained above, the mounting 104 may be used for placing or positioning the device 102. The plurality of electro-chromic layers may be placed at a body of the device 102. In this different exemplary embodiment, the plurality of electro-chromic layers may be placed at bottom of the device 102. FIG. 2B depicts a front view 200B of an exemplary device 102 according to a different exemplary embodiment of the invention. In the front view 200B, the plurality of electro-chromic layers 106/108/110 may be placed below or at bottom of the housing 112 of the device 102.

Figure 2C:
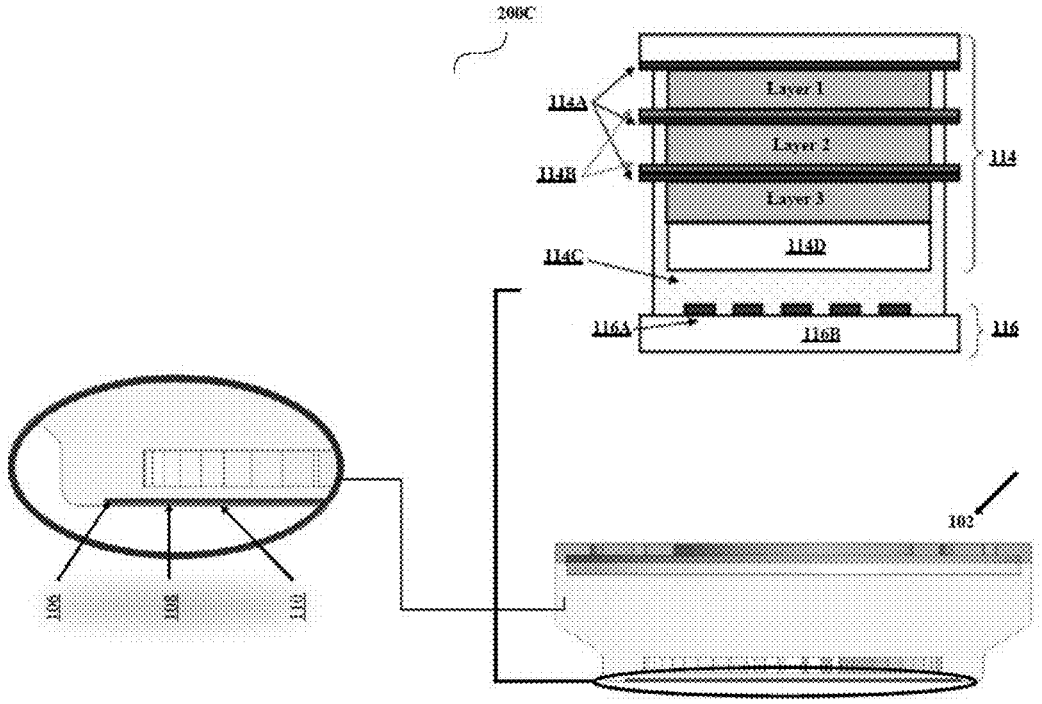

FIG. 2C depicts an exemplary arrangement 200C of a plurality of electro-chromic layers of an exemplary device 102 according to a different exemplary embodiment of the invention. In encircled portion, the plurality of electro-chromic layers 106/108/110 may be sandwiched and integrated at the bottom of the housing 112. As can be seen, the plurality of electro-chromic layers 106/108/110 may be placed at the bottom of the housing 112 of the device 102. Further, as shown in the left side of the FIG. 2C, the red electro-chromic layer 110 may be placed at the bottom-most side of the housing 112 and below the yellow electro-chromic layer 108. The yellow electro-chromic layer 108 may be placed between the green electro-chromic layer 106 and the red electro-chromic layer 110. Lastly, the green electro-chromic layer 106 may be placed above the yellow electro-chromic layer 108.

Moreover, the top-right side of the FIG. 2C shows a front plane 114 of the device 102. The front plane 114 of the device 102 may comprise, but is not limited to, one or more transparent electrodes 114A, one or more insulating layers 11B, electrolyte 114C and/or a white reflective layer 114D. The front plane 114 may further, comprise a magenta electro-chromic layer (Layer 1), a yellow electro-chromic layer (Layer 2), and/or a cyan electro-chromic layer (Layer 3) i.e. CMY. Alternatively, the front plane 114 may comprise a green electro-chromic layer 106, a yellow electro-chromic layer 108, and/or a red electro-chromic layer 110 as described above. Further, a single transparent electrodes 114A and a single insulating layers 114B may be placed between any two electro-chromic layers as shown in the front plane 114. Also, the top-right side of the FIG. 2C shows a backplane 116 of the device 102. The backplane 116 of the device 102 may comprise, but is not limited to, counter electrodes 116A and a non-transparent plastic layer 116B as explained above.

The electro-chromic layers 106/108/110 feature low electric potential driven color change which is complemented by favorable mechanical and processing properties with transparent conductors, electrochromic films, ion conductors, and an ion storage layer. Such layers undergo a reversible color change upon the adsorption and desorption of small cations. Ions are removed and returned to the ion-storage layer by reversing the polarity of the applied potential, thereby returning the electrochromic device to its original optical State. Following are some technical indicators of the electro-chromic layers:

Discoloration type: film

Driving voltage: 0.5 v-3V

Coloring efficiency: 160-5000 px2/C

Discoloration time: 5-20 Seconds

Degree of discoloration (light transmittance): <30%

Device specifications (thickness, diameter): 0.25 mm (Max)

Figure 3:
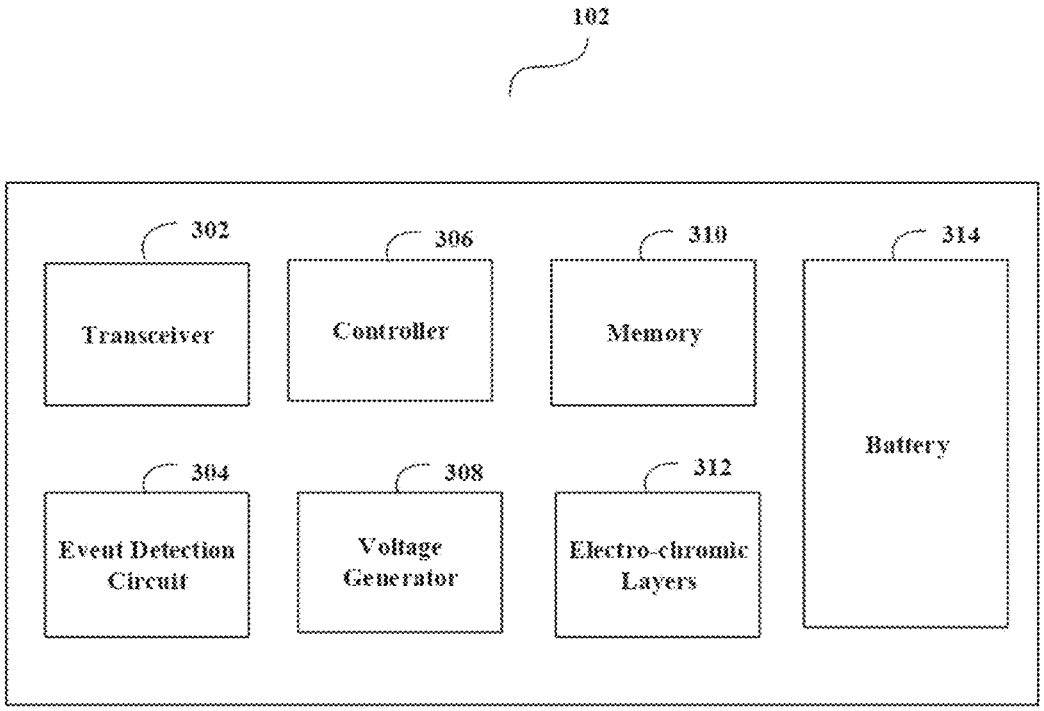
FIG. 3 depicts block diagram of different components of an exemplary device according to an exemplary embodiment of the invention.

FIG. 3 depicts a block diagram of different components of a device 102 according to an exemplary embodiment of the invention. In addition to the housing 112 and the mounting 104, the device 102 may comprise of, but is not limited to, a transceiver 302, an event detection circuit 304, a controller 306, a voltage generator 308, a memory 310, electro-chromic layers 312, and/or a battery 314. The transceiver 302 may be adapted to transmit and receive any information or data to any other device connected through a network. The event detection circuit 304 may be adapted to detect a plurality of events associated with the device 102. The event detection circuit 304 may use one or more sensor/s (not shown) and/or information related to the device 102 for detecting the plurality of events. Also, the plurality of events may comprise, but is not limited to, a normal working event, a low battery event, a warning event, an alarm event and/or a device expiration event.

The normal working event may correspond to an event when the device 102 is functioning properly and performing all the operations as expected. Also, the low battery event may correspond to an event when the charge in the battery 314 of the device 102 goes below a pre-defined threshold. For this, a manufacturer of the device 102 may define the pre-defined threshold of the battery charge at the time of manufacturing the device 102. The warning event may correspond to an event when the device 102 requires any repair, maintenance or a service or when the device 102 is unable to communicate with a fire panel. The device 102 may be unable to communicate with the fire panel due to disturbances in a communication medium. Further, the alarm event may correspond to an event when the device 102 detects fire or smoke. The device expiration event may correspond to an event when the device 102 is about to get expired. Further, an information related to expiry date of the device 102, the pre-defined threshold, and/or an expected maintenance date, an expected service date may be already stored in memory 310 of the device 102 at the time of manufacturing of the device 102.

The event detection circuit 304 may communicate the detected events to the controller 306. The controller 306 may generate a command or a signal for each of the detected events. For an instance, a signal or a command may be generated for the normal working event and another signal or command may be generated for the warning event. The controller 306 may communicate the command to the voltage generator 308 of the device 102. The voltage generator 308 may be adapted to generate voltage based on the command received from the controller 306. For each command, a corresponding voltage (in volts) may be already defined by a manufacturer of the device 102. For an instance, the voltage generator 308 may generate voltage of 0.8 volts based on a command for the alarm event. Similarly, the voltage generator 308 may generate voltage of 0.5 volts based on a command for the warning event. In order to generate an appropriate voltage for each command, the voltage generator 308 may use an output of a pulse width modulator (PWM) coupled with the controller 306. In particular, the voltage generator 308 may take the output of the pulse width modulator generated from controller 306 and may generate the output voltages as required. Further, the voltage generator 308 may generate an output voltage of any choice by inputting a controlled duty cycle of a PWM pulse from the controller 306. Also, by using the PWM, control registers available in controller 306 may generate the PWM pulses with different duty cycle. By doing this, any duty cycle PWM pulse in the range of (0-100%) may be generated.

The voltage generator 308 may be adapted to apply the generated voltage to one or more electro-chromic layers of a plurality of electro-chromic layers 106/108/110 embedded in the device 102. For this, the voltage generator 308 may use the charge available in the battery 314 of the device 102. Taking the same example as explained above, the voltage generator 308 may apply the generated voltage of 0.8 volts to a yellow electro-chromic layer 108 based on a command for the warning event. Similarly, the voltage generator 308 may apply the generated voltage of 0.5 volts to a red electro-chromic layer 110 based on a command for the alarm event.

The one or more electro-chromic layers 106/108/110 of a plurality of electro-chromic layers 312 may be adapted to glow with a color on the device 102 by application of the voltage generated by the voltage generator 308. For example, the yellow electro-chromic layer 108 may glow in yellow color when the voltage generator 308 applies the generated voltage of 0.8 volts for the warning event. Similarly, the red electro-chromic layer 110 may glow in red color when the voltage generator 308 applies the generated voltage of 0.5 volts for the alarm event or the device expiration event. In an exemplary embodiment, the one or more electro-chromic layers 106/108/110 may glow in red color when an alarm event is detected, may glow in shaded red color when a device expiration event is detected, may glow in yellow color when a warning event is detected, may glow in shaded yellow color if a maintenance/service event is detected, may glow in green color when a normal working event is detected or may glow in shaded green color when a low battery event is detected. Further, the one or more electro-chromic layers 106/108/110 may glow different colors at different generated voltage using red, green, yellow (RGY) spectrum or cyan, yellow, magenta (CYM) spectrum. Also, the one or more electro-chromic layers 106/108/110 may glow different colors by energizing or de-energizing the electro-chromic layers with application of different voltage. Thereby, by glowing a color, the device 102 may provide an indication to a user regarding any events associated with the device 102. An exemplary Table 1 provided below for various voltages generated for different events.

TABLE 1

| Event Detected | Voltage applied on electro-chromic layer | Color on electro-chromic layer |
|---|---|---|
| Alarm Event | 1-2 volts | Red color |
| Warning Event | 1-2 volts | Yellow Color |
| Normal Working Event | 1-2 volts | Green Color |
| Device Expiration Event | 0.5 volts | Shaded Red Color |
| Low Battery Event | 0.5 volts | Shaded Green Color |
| Service/Maintenance Event | 0.5 volts | Shaded Yellow Color |

As explained in Table 1 above, an alarm event may be indicated by glowing red color when 1-2 volts is applied on the red electro-chromic layer 110 and a device expiration event may be indicated by glowing shaded red color when 0.5 volts is applied on the red electro-chromic layer 110. Similarly, a warning event may be indicated by glowing yellow color when 1-2 volts is applied on the yellow electro-chromic layer 108 and a service/maintenance event may be indicated by glowing shaded yellow color when 0.5 volts is applied on the yellow electro-chromic layer 108. Also, a normal working event may be indicated by glowing green color when 1-2 volts is applied on the green electro-chromic layer 106 and a low battery event may be indicated by glowing shaded green color when 0.5 volts is applied on the green electro-chromic layer 106.

Moreover, the transceiver 302, the event detection circuit 304, the voltage generator 308, the memory 310, the electrochromic layers 312, and/or the battery 314 may be communicably coupled with the controller 306. The different units described herein are exemplary. The invention may be performed using one or more units. For example, the tasks executed by the transceiver 302, the event detection circuit 304, the voltage generator 308, the memory 310, the electrochromic layers 312, the battery 314 and/or the controller 306 may be performed by a single unit. Alternatively, more number of units as described herein may be used to perform the present invention.

It may be noted that the present invention uses various other colors such as blue, orange, magenta, purple and the like that may also glow at different voltages applied based on different events. In addition, various events may be categorized based on lighter and darker version of the same color. This has been explained in FIG. 4 below with different exemplary scenarios. According to the embodiment of the invention, application of a lower voltage may glow lighter version of a particular color and enhanced voltage may glow a corresponding darker version of the particular color. Alternatively, this may also be possible by applying voltage to a single electrochromic layer when lighter version of a color is required and to more number of electrochromic layers when a darker version of the particular color is required.

The present invention further encompasses the device 102 to assign a priority to each of the plurality of detected events. The device 102 may assign a low priority, a medium priority or a high priority to each of the detected events. The assigning of the priority to each of the plurality of detected events may help in avoiding any sort of conflict and may also enable the device 102 to glow with only one color at a time. For an instance, if the warning event and the alarm event may occur at the same time in the device 102, then in such a scenario, the warning event may be assigned with low priority and the alarm event may be assigned with high priority. This is because warning event/s like repair, maintenance or a service can be performed at a later time and may be kept on-hold for some time. However, in the case of the alarm event of the device 102, such event require urgent attention from the user of the device 102 and cannot be kept on-hold. Once the alarm event is resolved, the device 102 may inform the user regarding the event/s which were kept on hold or assigned with low priority. In an exemplary embodiment, a darker version of a particular color may be used to show an event with high priority and a lighter version of the same color may be used to show an event with low priority or vice-versa. The voltage may also be applied to two or more electrochromic layers at the same in order to bring different colors for informing the user about the high or low priority events.

Figure 4:
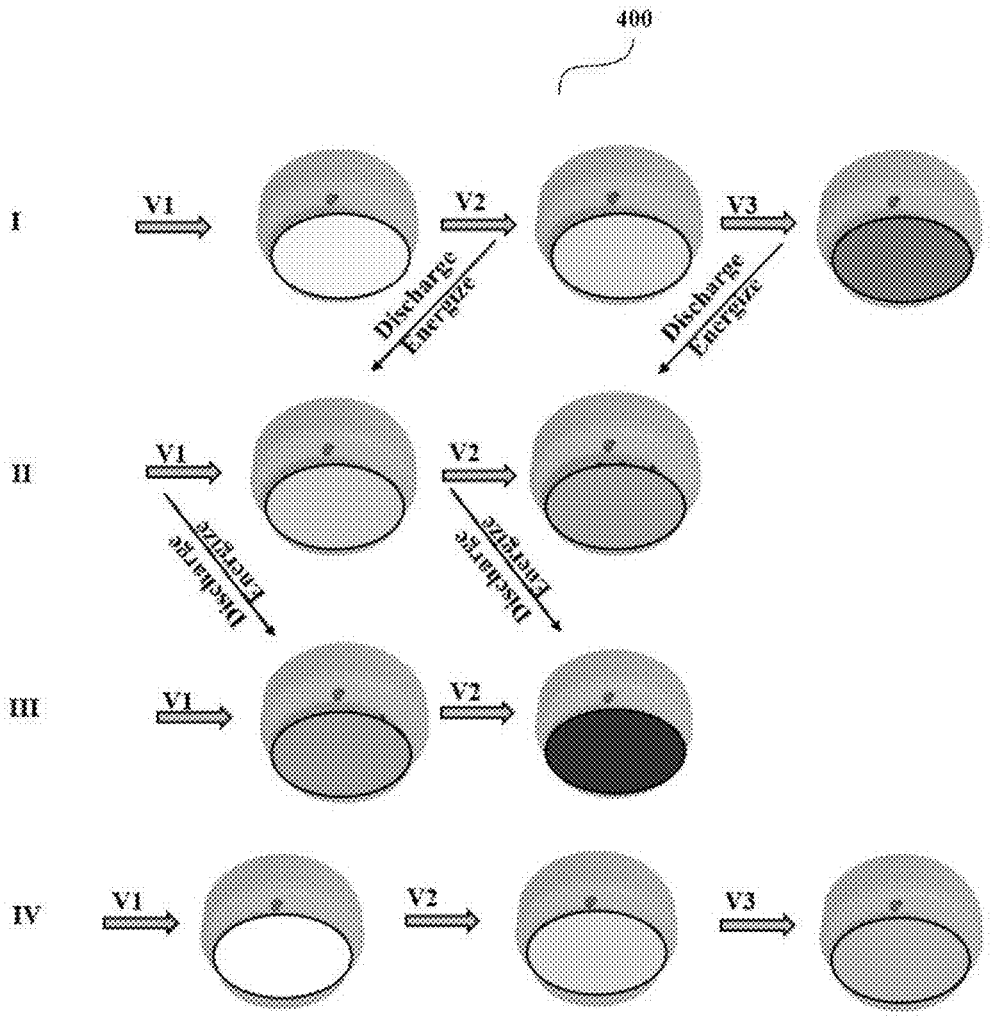
FIG. 4 depicts exemplary scenarios for different events associated with an exemplary device according to an exemplary embodiment of the invention.

FIG. 4 depicts exemplary scenarios 400 for different events associated with an exemplary device 102 according to an exemplary embodiment of the invention. In an exemplary scenario I, the red electro-chromic layer 110 may change color in intervals when a device expiration event or an alarm event is detected in the device 102. For an instance, if the device 102 has an expiry date of 5 years from the date of manufacturing of the device 102, then 0.5 volts (voltage v1) may be applied to the red electro-chromic layer 110 at the expiry of 3 years to make the red electro-chromic layer 110 to glow in light red or peach color. Also, 0.8 volts (voltage v2) may be applied to the red electro-chromic layer 110 at the expiry of 4 years to make the red electro-chromic layer 110 to glow in red color. Further, 1.25 volts (voltage v3) may be applied to the red electro-chromic layer 110 at the expiry of 5 years to make the red electro-chromic layer 110 to glow in dark red color. The further darker or darkest version of the red color may indicate that the device 102 is about to complete its lifetime and needs to be replaced (say after 5 years since installation).

In an exemplary scenario II, the yellow electro-chromic layer 108 may change color in intervals when a warning event or a replacement event is detected in the device 102. For an instance, if the device 102 needs service or maintenance, then 0.8 volts (voltage v1) may be applied to the yellow electro-chromic layer 108 to make the yellow electro-chromic layer 108 to glow in yellow color. And if the service or maintenance is not conducted in a pre-defined interval of time (say, in 1 day), then, 1.25 volts (voltage v2) may be applied to the yellow electro-chromic layer 108 to make the yellow electro-chromic layer 108 to glow in dark yellow color.

In an exemplary scenario III, the green electro-chromic layer 106 may change color in intervals when the normal working event or the low battery event in detected in the device 102. For example, 0.8 volts (voltage v1) may be applied to the green electro-chromic layer 106 to make the green electro-chromic layer 106 to glow in light green color for informing the user regarding the normal working event. Further, 1.25 volts (voltage v2) may be applied to the green electro-chromic layer 106 to make the green electro-chromic layer 106 to glow in dark green color for informing the user regarding the low battery event in the device 102.

In an exemplary scenario IV, other colors may also be shown in the device 102 for informing the user regarding a first alert by applying 0.5 volts (voltage v1), a second alert by applying 0.8 volts (voltage v2), and/or a third alert by applying 1.25 volts (voltage v3) in the device 102. The scenarios for different events explained in the specification are only for explanation purpose and other scenarios for any other event informed to users by showing any other color are also within the scope of this invention.

Further, the generated voltage may be applied to any of the electro-chromic layer 106/108/110 and based on the command from the controller 306, the same generated voltage may be transferred by discharging from an ion storage layer of a 1st electro-chromic layer to a second electro-chromic layer. Also, a single input voltage may be enough to provide all visual notifications (to inform the user) for desired color for life time or until complete energy losses. For an instance, the darker color on the electro-chromic layer may need higher energy input of 1.25 Volts to 2 Volts (which comparatively consumes less energy compared to LEDs which needs voltage (energy) input for every event).

The electro-chromic layers 106/108/110 offer technical following advantages: 1) high quality and longer range visual indication than LEDs; 2) provides real time and continuous visual indication for the user; 3) low cost manufacturing process; 4) very low operating cost; 5) temperature resistant up to 100-120° C.; 5) high reliability and fast in switching colors based on the events; 6) high Aesthetics with elegant look and feel; and 7) energy savings.

Figure 5:
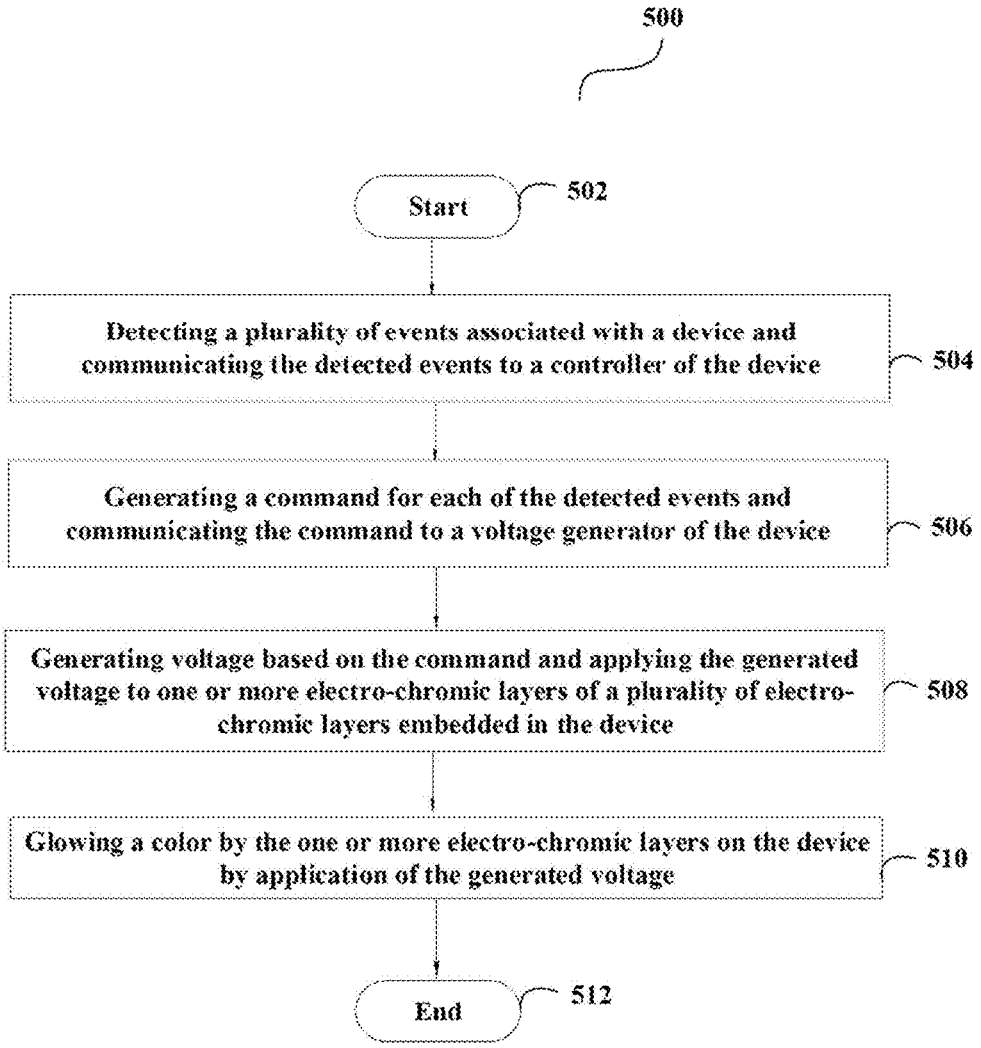
FIG. 5 depicts an exemplary flowchart illustrating a method to perform the invention according to an exemplary embodiment of the invention.

FIG. 5 depicts a flowchart outlining the features of the invention in an exemplary embodiment of the invention. The method flowchart 500 describes a method being for providing an indication to a user regarding events associated with a device 102. The method flowchart 500 starts at step 502.

At step 504, a device 102 may detect a plurality of events associated with the device 102 and may communicate the detected events to a controller 306 of the device 102. This has been discussed above in FIG. 3 in greater details.

At step 506, the device 102 may generate a command for each of the detected events and communicate the command to a voltage generator 308 of the device 102. This has been discussed above in FIG. 3 in greater details.

At step 508, the device 102 may generate voltage based on the command and apply the generated voltage to one or more electro-chromic layers 106/108/110 of a plurality of electro-chromic layers embedded in the device 102. This has been discussed above in FIG. 3 in greater details.

At step 510, the one or more electro-chromic layers 106/108/110 on the device 102 may glow a color by application of the generated voltage. This has been discussed above in FIG. 3 in greater details. Then, the method flowchart 500 may end at 512.

The present invention is applicable to various fields/industries such as, but not limited to, hospitality industry, real-estate industry, hostels, educational institutes, banking sector, automobile industry, and any such field/industry where the device 102 can be used and is obvious to a person skilled in the art.

In one embodiment of the invention, the invention can be operated using the one or more computer readable devices. The one or more computer readable devices can be associated with a device 102. A computer readable medium comprises one or more processors and a memory coupled to the one or more processors, the memory stores instructions executed by the one or more processors. The one or more processors configured to detect a plurality of events associated with a device 102 and communicate the detected events to a controller 306 of the device 102. The one or more processors configured to generate a command for each of the detected events and communicate the command to a voltage generator 308 of the device 108. The one or more processors also configured to generate voltage based on the command and apply the generated voltage to one or more electro-chromic layers 106/108/110 of a plurality of electro-chromic layers embedded in the device 102. The one or more processors also configured to glow a color by the one or more electro-chromic layers 106/108/110 on the device 102 by application of the generated voltage.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures/Tables and described herein. Other examples of the invention may include different computer-executable instructions or components having more or less functionality than illustrated and described herein. Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit Nano-scale architectures such as, but not limited to, molecular and quantum-dot based transistors, switches and gates, in order to optimize space usage or enhance performance of user equipment. A processor may also be implemented as a combination of computing processing units.

In the subject specification, terms such as "data store," "data storage," "database," "cache," and substantially any other information storage component relevant to operation and functionality of a component, refer to "memory components," or entities embodied in a "memory" or components comprising the memory. It will be appreciated that the memory components, or computer-readable storage media, described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Additionally, the disclosed memory components of systems or methods herein are intended to comprise, without being limited to comprising, these and any other suitable types of memory.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C".

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A device comprising:

an event detection circuit adapted to detect a plurality of events associated with the device and communicate the detected events to a controller;

the controller adapted to generate a command for each of the detected events and communicate the command to a voltage generator of the device;

the voltage generator adapted to generate voltage based on the command and apply the generated voltage to one or more electro-chromic layers of a plurality of electro-chromic layers embedded in the device; and the one or more electro-chromic layers adapted to glow with a color on the device by application of the generated voltage;

wherein the one or more electro-chromic layers glow in red color when an alarm event is detected, glow in shaded red color when a device expiration event is detected, glow in yellow color when a warning event is detected, glow in shaded yellow color if a maintenance/service event is detected, glow in green color when a normal working event is detected or glow in shaded green color when a low battery event is detected.

2. The device of claim 1, wherein the device is a fire detector.

3. The device of claim 1, wherein the plurality of events detected by the event detection circuit comprises a normal working event, a low battery event, a warning event, an alarm event and/or a device expiration event.

4. The device of claim 3, wherein the warning event corresponds to an event when the device requires a maintenance, repair or a service or when the device is unable to communicate with a fire panel.

5. The device of claim 3, wherein the alarm event corresponds to an event when the device detects any fire or smoke.

6. The device of claim 1, wherein the one or more electro-chromic layers glow with a color on the device for providing an indication to a user regarding the detected events.

7. The device of claim 1, wherein the controller is coupled with a pulse width modulator (PWM) to control the voltage or current and an output of the pulse width modulator is used by the voltage generator to generate voltage.

8. The device of claim 1, wherein the voltage generator applies the generated voltage to the one or more electro-chromic layers using a battery of the device.

9. The device of claim 1, wherein each of the plurality of events is assigned with a low priority, a medium priority or a high priority.

10. The device of claim 1, wherein the plurality of electro-chromic layers are separated by an insulating layer and are placed at a bottom or a side surface or at a body of the device.

11. The device of claim 1, wherein the one or more electro-chromic layers glow different colors at different generated voltage using red, green, yellow (RGY) spectrum or cyan, yellow, magenta (CYM) spectrum.

12. The device of claim 1, wherein the one or more electro-chromic layers glow different colors by energizing or de-energizing the electro-chromic layers with application of different voltage.

13. A method comprising:

detecting a plurality of events associated with a device and communicating the detected events to a controller of the device;

generating a command for each of the detected events and communicating the command to a voltage generator of the device;

generating voltage based on the command and applying the generated voltage to one or more electro-chromic layers of a plurality of electro-chromic layers embedded in the device; and glowing a color by the one or more electro-chromic layers on the device by application of the generated voltage;

wherein the one or more electro-chromic layers glow in red color when an alarm event is detected, glow in shaded red color when a device expiration event is detected, glow in yellow color when a warning event is detected, glow in shaded yellow color if a maintenance/service event is detected, glow in green color when a normal working event is detected or glow in shaded green color when a low battery event is detected.

14. The method of claim 13, wherein the device is a fire detector.

15. The method of claim 13, wherein the plurality of events detected by the event detection circuit comprises a normal working event, a low battery event, a warning event, an alarm event and/or a device expiration event.

16. The method of claim 13, wherein each of the plurality of events is assigned with a low priority, a medium priority or a high priority.

17. The method of claim 13, wherein the controller employs a pulse width modulator (PWM) to control the voltage or current and an output of the pulse width modulator is used by the voltage generator to generate voltage.

18. The method of claim 13, wherein the one or more electro-chromic layers glow different colors at different generated voltage using red, green, yellow (RGY) spectrum or cyan, yellow, magenta (CYM) spectrum.

19. A computer readable medium comprising a non-transitory memory, the memory storing instructions executed by the one or more processors, the one or more processors configured to:

detect a plurality of events associated with a device and communicate the detected events to a controller of the device;

generate a command for each of the detected events and communicate the command to a voltage generator of the device;

generate voltage based on the command and apply the generated voltage to one or more electro-chromic layers of a plurality of electro-chromic layers embedded in the device; and glow a color by the one or more electro-chromic layers on the device by application of the generated voltage;

wherein the one or more electro-chromic layers glow in red color when an alarm event is detected, glow in shaded red color when a device expiration event is detected, glow in yellow color when a warning event is detected, glow in shaded yellow color if a maintenance/service event is detected, glow in green color when a normal working event is detected or glow in shaded green color when a low battery event is detected.

* * * * *